US008047530B2

(12) United States Patent
Harston

(10) Patent No.: US 8,047,530 B2
(45) Date of Patent: Nov. 1, 2011

(54) ROTARY TRANSFER MECHANISM

(75) Inventor: John Christopher Harston, Clevedon (GB)

(73) Assignee: Kliklok Corporation, Decatur, GA (US)

( * ) Notice: Subject to any disclaimer, the term of this patent is extended or adjusted under 35 U.S.C. 154(b) by 290 days.

(21) Appl. No.: 11/997,012

(22) PCT Filed: Jul. 5, 2006

(86) PCT No.: PCT/GB2006/002489
§ 371 (c)(1),
(2), (4) Date: Jan. 28, 2008

(87) PCT Pub. No.: WO2007/015049
PCT Pub. Date: Feb. 8, 2007

(65) Prior Publication Data

US 2008/0227612 A1 Sep. 18, 2008

(30) Foreign Application Priority Data

Aug. 4, 2005 (GB) ..... 0516051.0

(51) Int. Cl.
*B65H 3/08* (2006.01)
*B31B 1/80* (2006.01)

(52) U.S. Cl. ..... 271/91; 271/95; 271/99; 271/100; 271/102; 271/107; 493/313; 493/315

(58) Field of Classification Search ..... 271/91, 271/95, 99, 100, 102, 103, 107; 493/313, 493/315
See application file for complete search history.

(56) References Cited

U.S. PATENT DOCUMENTS

| | | | | |
|---|---|---|---|---|
| 4,871,348 | A * | 10/1989 | Konaka | 493/315 |
| 4,881,934 | A * | 11/1989 | Harston et al. | 493/315 |
| 5,215,515 | A | 6/1993 | Bershadsky | |
| 5,257,888 | A * | 11/1993 | Kronseder | 414/416.06 |
| 5,426,920 | A * | 6/1995 | Quadalti | 53/564 |
| 5,431,274 | A | 7/1995 | Schaupp | |
| 6,383,123 | B1 * | 5/2002 | Ehring et al. | 493/315 |
| 6,503,180 | B1 | 1/2003 | Pluschow et al. | |
| 2007/0257416 | A1 * | 11/2007 | Ford | 271/91 |

FOREIGN PATENT DOCUMENTS

| | | |
|---|---|---|
| EP | 0 331 325 | 9/1989 |
| EP | 0 580 958 | 2/1994 |
| EP | 1 388 495 | 2/2004 |
| WO | WO 03/020615 | 3/2003 |

* cited by examiner

*Primary Examiner* — Stefanos Karmis
*Assistant Examiner* — Luis A Gonzalez
(74) *Attorney, Agent, or Firm* — King & Schickli, PLLC

(57) ABSTRACT

A rotary transfer mechanism for transferring flat sleeve cartons (20) from a magazine (22) to a receiving station (23) on a conveyor (24), with opening of the cartons ready to receive end-loaded product, is characterized in that the path of suction cups (32) for holding the cartons during transfer is basically determined by a continuous stationary cam track (34) permanently engaged by a cam follower (37) on a gear segment (35) pivotally mounted on carrier means (29) rotatable by a drive shaft (26), the suction cups (32) being carried by a support shaft (30) rotatable on the carrier means and coaxial with a pinion (38) meshing with the gear segment. (35), and the support shaft being connected to a bracket (48) carrying a manifold (47) for the suction cups (32) by a crank arm (53), which is connected by a link arm (54) to a rocker arm (55) freely rotatable on the drive shaft (26). A servomotor (27) programmed by a computer (not shown) drives the drive shaft (26) through a gearbox (28) to vary the speed of the suction cups (32), especially when passing through the delivery station (23) to effect opening of the cartons (20) by movement relative to flights (64) on the conveyor (24).

5 Claims, 12 Drawing Sheets

ROTARY TRANSFER MECHANISM

FIELD OF THE INVENTION

This invention relates to a rotary transfer mechanism for extracting a flat article from the discharge opening of a magazine and depositing it at a receiving station.

BACKGROUND OF THE INVENTION

Such a mechanism is described in EP-A-0331325 comprising a support member, a drive shaft rotatably mounted on and extending from the support member, means for rotatably driving the drive shaft, carrier means rotatable with the drive shaft, at least one support shaft rotatable on the carrier means substantially parallel to the drive shaft, whereby the support shaft can orbit round the drive shaft, means for controlling the rotational disposition of the support shaft with respect to the carrier means, at least one suction cup attached to the support shaft, means for producing a vacuum, means alternatively connecting the suction cup with the vacuum-producing means and the atmosphere, the means for controlling the support shaft including means causing the suction cup while connected with the vacuum producing means to contact an article at the discharge opening of the magazine, extract the article from the magazine, and transfer the article to the receiving station, whereupon the suction cup is connected with the atmosphere to release the article to the receiving station, characterised in that the means for controlling the at least one support shaft comprises on the one hand, a pinion secured coaxially to the support shaft, and an arcuate rack secured to the support member in such a position as to act upon the pinion to create a partial path of the at least one suction cup with a "node point" at the discharge opening of the magazine; and, on the other hand, a cam follower on an arm extending laterally from the support shaft, and a cam track secured to the support member and of such an operative extent as to act upon the cam follower when the arcuate rack is not acting on the pinion, the profile of the cam track being such as to cause the suction cup to move past the receiving station in the same direction as the conveyor with the article generally parallel to the conveyor.

Thus, the suction cup "plucks" each article from the magazine, but instead of merely dropping the article at the receiving station, the suction cup imparts to the article a major component of motion in the direction of movement of the conveyor, with consequent better placement of the article on the conveyor. The flexibility of design in suction cup path afforded by the combination of the ratio of the rack-and-pinion drive, the disposition of the rack, and the profile of the operative extent of the cam track, allows for a wide choice of article length and disposition of magazine, whilst avoiding interference between the magazine or the conveyor with the article while it is being transferred. This is particularly important when the conveyor has flights for the timed positioning of the articles in relation to a subsequent operation, such as when the article is a sleeve carton presented on the conveyor in open condition ready for end loading with a product at a subsequent station.

SUMMARY OF THE INVENTION

An object of the present invention is to provide a simpler and more compact rotary transfer mechanism than that of EP-A-0331325.

Another object is to keep the fed article path beyond the perimeter of the rotating mechanism at all times, thus enabling, in a sleeve carton feeding, erecting, and end-loading machine, product to be loaded, adjacent to fed cartons, to pass unhindered beneath the mechanism.

A further object is to enable the mechanism to partially overhang the conveyor, thus reducing cantilevered loads and inertia of the at least one suction cup.

Yet another object is to provide an improved path for the fed article, particularly a sleeve carton, as compared with the path afforded by the mechanism of EP-A-0331325.

A still further object is to provide a programmed variable motion path for the fed article, particularly of a sleeve carton with respect to its dimensions, thus giving further carton erection improvements by optimising carton erection geometry.

According to the present invention, a rotary transfer mechanism for extracting a flat article from the discharge opening of a magazine and depositing it at a receiving station on a conveyor comprises a support member, a drive shaft rotatably mounted on and extending from the support member, means for rotatably driving the drive shaft, carrier means rotatable with the drive shaft, at least one support shaft rotatable on the carrier means substantially parallel to the drive shaft, whereby the support shaft can orbit round the drive shaft, means for controlling the rotational disposition of the support shaft with respect to the carrier means, at least one suction cup attached to the support shaft, means for producing a vacuum, means alternatively connecting the suction cup with the vacuum-producing means and the atmosphere, the means for controlling the support shaft including means causing the suction cup while connected with the vacuum producing means to contact an article at the discharge opening of the magazine, extract the article From the magazine, and transfer the article to the receiving station, whereupon the suction cup is connected with the atmosphere to release the article to the receiving station, characterised in that the means for controlling the at least one support shaft comprises a continuous stationary cam track, a gear segment on a pivot on the carrier means axially parallel to the drive shaft, a cam follower on the gear segment permanently engaged with the cam track, and a pinion secured coaxially to the support shaft and permanently meshing with the gear segment, the profile of the cam track being such as to act on the gear segment along one part of the track to oscillate the pinion to create a partial path of the at least one suction cup with a "node point" at the discharge opening of the magazine, and along another part of the track to partially rotate the pinion so as to cause the suction cup to move past the receiving station in the same direction as the conveyor with the article generally parallel to the conveyor.

Thus the carrier means needs to have a radial extent little more than the radial distance of the support shaft from the drive shaft, while the maximum radial extent of the cam track can be appreciably less, thus minimising the radial extent of the carrier means.

As applied to a machine for transferring flat sleeve cartons from the discharge opening of a magazine to a receiving station on a conveyor having flights, opening of the cartons, ready for end loading with a product at a subsequent station along the conveyor, is facilitated by arranging for the combined action of the means for rotatably driving the drive shaft and the means for controlling the at least one support shaft so that at the receiving station the at least one suction cup is moving in the same direction as the conveyor relatively at a slightly greater speed, whereby the relative movement between the suction cup, holding one side of a sleeve carton, and leading flights on the conveyor, which flights are abutted by the leading corner fold of the carton, is such as to effect an opening of the carton which is substantially completed before the carton is abutted by trailing flights on the conveyor to hold the carton in its fully open condition as it passes to and through a subsequent end-loading station.

According to a feature of special significance, the drive shaft is rotatably driven by a servomotor programmed by a computer, to afford variation in the speed of the at least one suction cup along its path through the receiving station, particularly to suit different sizes of sleeve cartons.

Conveniently, three support shafts are provided with two or more suction cups attached to each shaft; but two, or four or more support shafts may be provided, depending on the size of the article to be transferred and/or the spacing of articles on a conveyor; and, likewise, three or more suction cups may be attached to each support shaft, depending on the size and/or weight of article to be transferred.

The or each pair (or more) of suction cups is preferably carried by a cantilever from a bracket secured on one end of a crank arm the other end of which is pivoted to the support shaft, and the bracket is secured to one end of a link arm the other end of which is pivoted to one end of a rocker arm the other end of which is freely rotatable on the drive shaft, whereby as the crank arm swings the suction cups are orientated accordingly, firstly for contact with an article at the discharge opening of the magazine, and secondly as required for passage through the receiving station on the conveyor.

The cam track is preferably provided on a disc mounted inside a casing forming the carrier means along with the gear segment and cam follower, and the pinion, with the or each support shaft exiting through a sealed bearing, and with the drive shaft passing through the support member and coaxially through the casing via sealed bearings, from a gearbox and motor (e.g. a servomotor) to the rocker arm, thus effecting driving of the casing through the link arm, the crank arm and the support shaft; thus enabling the use of a steel cam plate with attendant accuracy and durability, steel gear segment and cam follower, and steel pinion, with permanent lubrication affording increased life expectation and potential noise reduction:

BRIEF DESCRIPTION OF THE DRAWING FIGURES

An embodiment of the invention will now be described, by way of example only, with reference to the accompanying drawings, in which.

Figure 7:
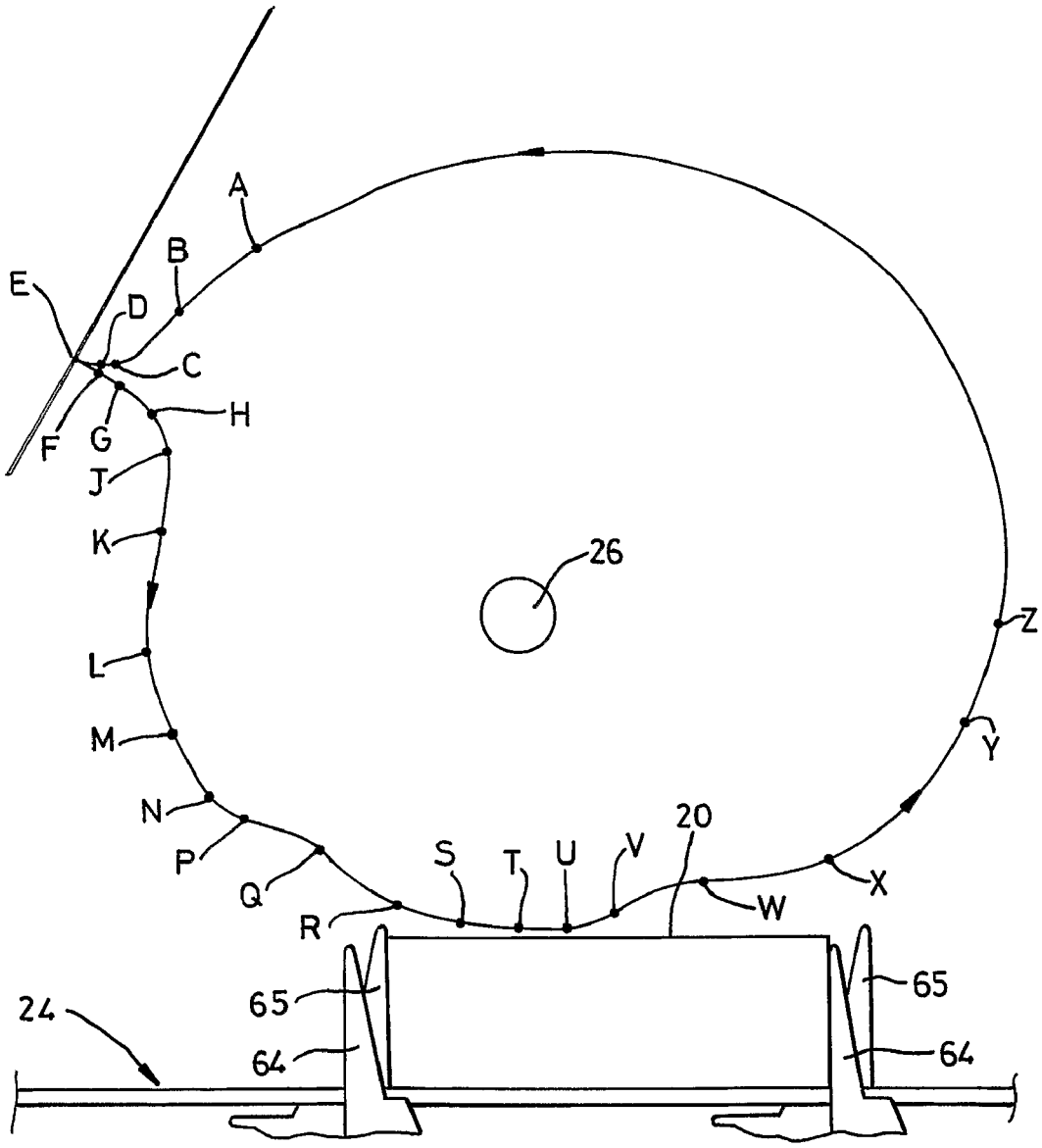
FIG. 7 is a diagram showing the path followed by any one suction cup in each set shown in FIGS. 1 to 4 and 6 with the largest size of sleeve carton that can be handled by the mechanism.
Figure 8:
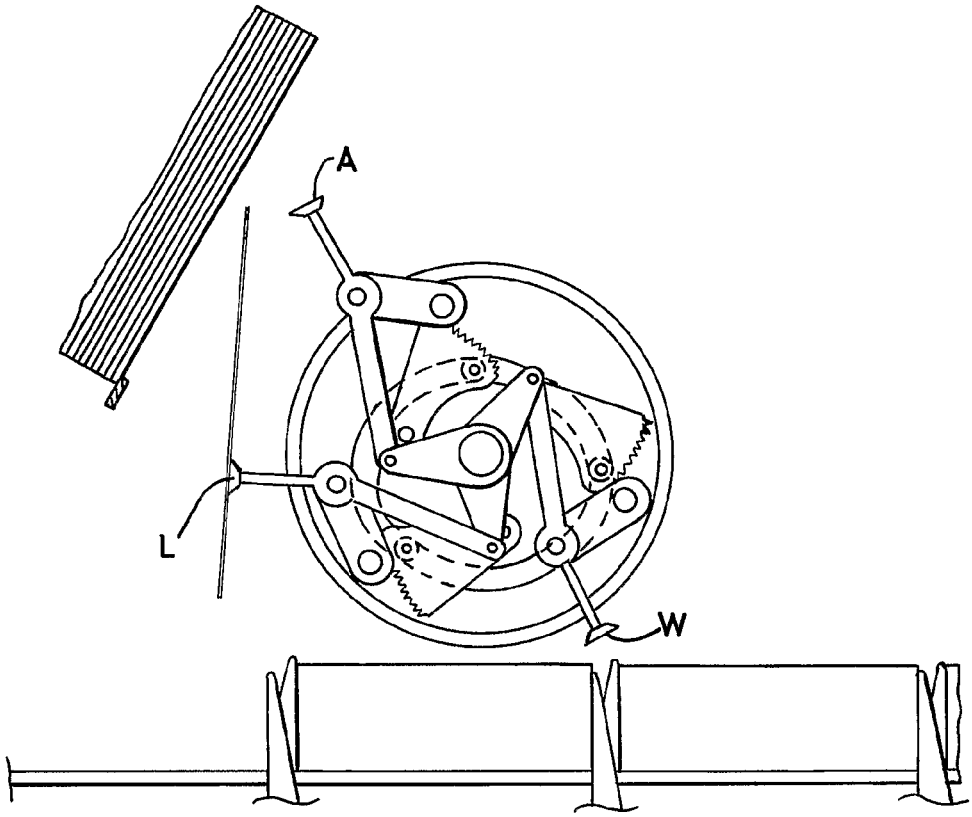
FIGS. 8 to 17 are diagrams illustrating a sequence of positions of the mechanism as each set of suction cups approaches a magazine for collapsed sleeve cartons, through extraction and erection of a carton plucked from the magazine, to release of the erected carton between flights of a conveyor passing through a delivery station.
Figure 9:
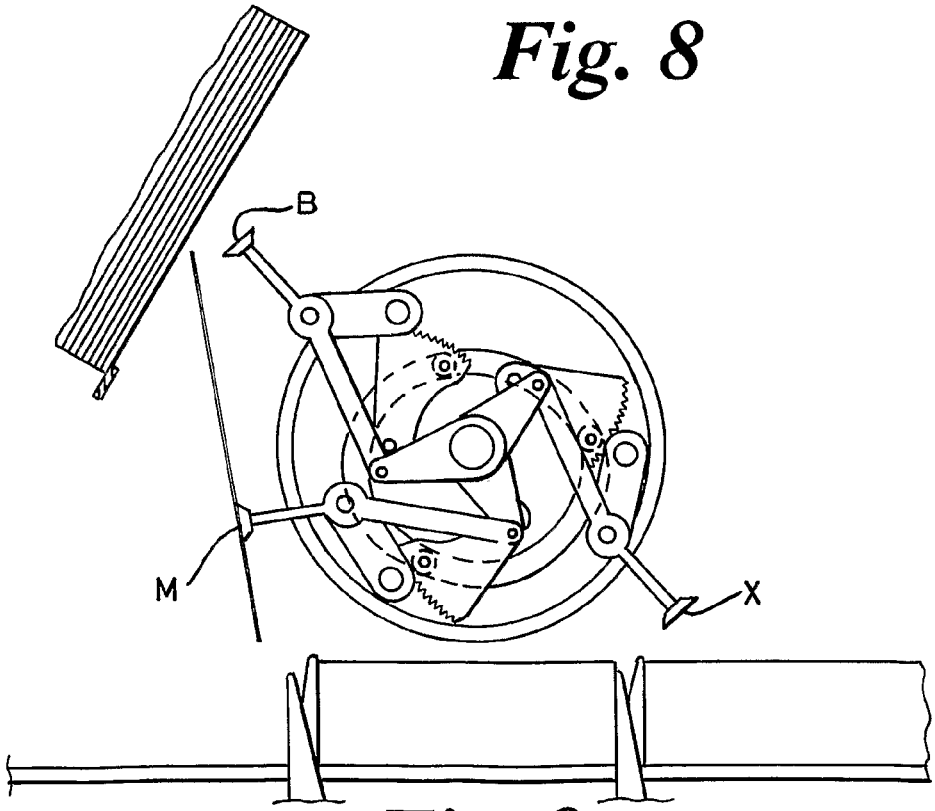
Figure 18:
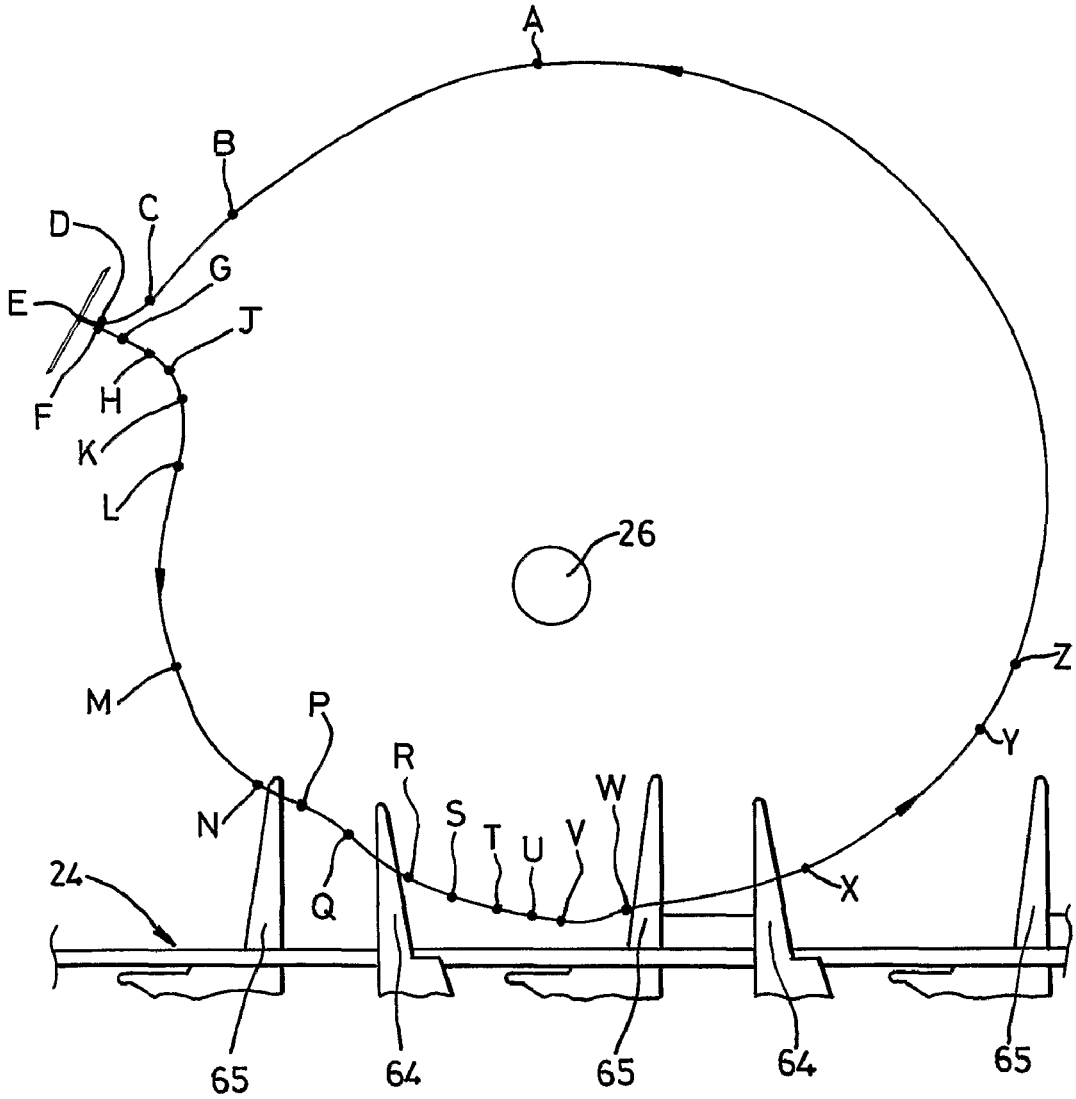

FIG. 18 corresponds to FIG. 7 but is the equivalent diagram showing how the suction cup path can be varied to suit a much smaller sleeve carton.

DETAILED DESCRIPTION OF THE INVENTION

Referring to FIGS. 1 to 6, the rotary transfer mechanism, for extracting a flat sleeve carton 20 from the discharge opening or "gate" 21 of a magazine 22 and depositing it, erected, at a receiving station 23 on a conveyor 24, comprises a support member 25, a drive shaft 26 rotatably mounted on and extending from the support member, means for rotatably driving the drive shaft consisting of a servomotor 27 programmed by a computer (not shown) and gearbox 28, carrier means 29 rotatable with the drive shaft, three support shafts 30 rotatable on the carrier means substantially parallel to the drive shaft, whereby each support shaft can orbit round the drive shaft, means 31 for controlling the rotational disposition of each support shaft with respect to the carrier means, four suction cups 32 attached to each support shaft, means (not shown) for producing a vacuum, means 33 alternately connecting the suction cups with the vacuum producing means and the atmosphere, the means 31 for controlling the support shafts including means causing the suction cups 32 while connected to the vacuum producing means to contact a carton 20 at the discharge opening 21 of the magazine 22, extract the carton from the magazine, and transfer the carton to the receiving station 23 on the conveyor 24, whereupon the suction cups 32 are connected with the atmosphere to release the carton 20 to the receiving station 23, characterised in that the means 31 for controlling the support shafts 30 comprises a continuous stationary cam track 34, gear segments 35 on pivots 36 on the carrier means 29 axially parallel to the drive shaft 26, cam followers 37 on the gear segments permanently engaged with the cam track, and pinions 38 secured coaxially to the respective support shafts 30 and permanently meshing with the gear segments, the profile of the cam track 34 being such as to act through the cam followers 37 on the gear segments 35 along one part of the track to oscillate the respective pinions 38 to create a partial path of the respecting sets of four suction cups 32 with a "node point" at the discharge opening 21 of the magazine 22, and along another part of the track 34 to partially rotate the pinions 38 so as to cause the respective sets of four suction cups 32 to move past the receiving station 13 in the same direction as the conveyor 14 with the respective cartons 20 generally parallel to the conveyor.

The vacuum-producing means comprises two suction pumps (not shown) connected by pipelines 39, 40 to arcuate ports 41, 42 in a stationary valve plate 43 of the vacuum control means 33, a rotary valve plate 44 of which is driven with the drive shaft 26. The drive shaft is hollow and contains three tubes 45, one for each set of four suction cups 32 to which connection is made by means of flexible pipes 46 (indicated by broken lines only in FIG. 2 for the sake of clarity) from the nearer ends of the respective tubes 45 to manifold tubes 47 cantilevered from mounting blocks 48. The other ends of the tubes 45 are connected by flexible pipes 49 to respective ports 50 in the rotary valve plate 44 which co-operate with the ports 41, 42 in the stationary valve plate 43, to provide vacuum at the suction cups 32, communication with the arcuate port 41 enabling a carton 20 to be plucked from the magazine 22, the feed line 39 from the respective pump to the port 41 being switched off via a solenoid valve (not shown) to avoid plucking a carton when missing product is detected. The arcuate port 42 enables a plucked carton to be carried into the delivery station 23 on the conveyor 24 whilst the next carton is plucked from the magazine by the next set of suction cups 32. A third arcuate port 51 in the stationary valve plate 43 is an exhaust port only, allowing vacuum to be 'dumped' to atmosphere, thus releasing each carton when erection is complete, and this port communicates with the atmosphere via a nipple 52 which may be provided with means to prevent ingress of contamination in very dirty atmospheres.

Each bracket 48 is pivoted on one end of a crank arm 53 the other end of which is secured to the respective support shaft 30, and the bracket is secured to one end of a link arm 54 the other end of which is pivoted to one end of a rocker arm 55 the other end of which is freely rotatable on the drive shaft 26, whereby, as the crank arm 53 swings the respective suction cups 32 are orientated accordingly, firstly for contact with a carton blank 20 at the discharge opening 21 of the magazine 22, and, secondly, as required for passage through the receiving station 23 on the conveyor 24.

The cam track 34 is provided on a plate 56 mounted inside a two-part casing 57, 58 forming the carrier means 29 along with the gear segments 35 and cam followers 37, and the pinions 38, with the support shafts 30 exiting through sealed bearings (not visible) from the casing port 57, and with the drive shaft 26 passing through the support member 25 and coaxially through the gearbox 28 and the two-part casing 57, 58 via bearings 59, 60 to the rocker arms 55 (each on a bearing indicated by a small x), thus effecting driving of the carrier means 29 through the link arms 54, the crank arms 53 and the support shafts 30. The cam plate 56 is secured to the gearbox 28 by four screws 61 and houses the bearing 59, the other bearing 60 being housed within the gearbox on a spigot 62 extending from a bevel gear 63 meshing with a bevel gear (not visible) driven by the servomotor 27.

As each crank arm 53 swings the respective set of suction cups 32 are orientated accordingly, and particularly as appropriate from position A to position V in FIG. 7 along the path traced by the common centre line of the rims of each set of suction cups, which together with eighteen intermediate positions are shown in FIGS. 8 to 17 in relation to the attitude of a sleeve carton 20 from the discharge opening or "gate" 21 of the magazine 22 to release at the delivery station 23 on to the conveyor 24.

Figure 10:
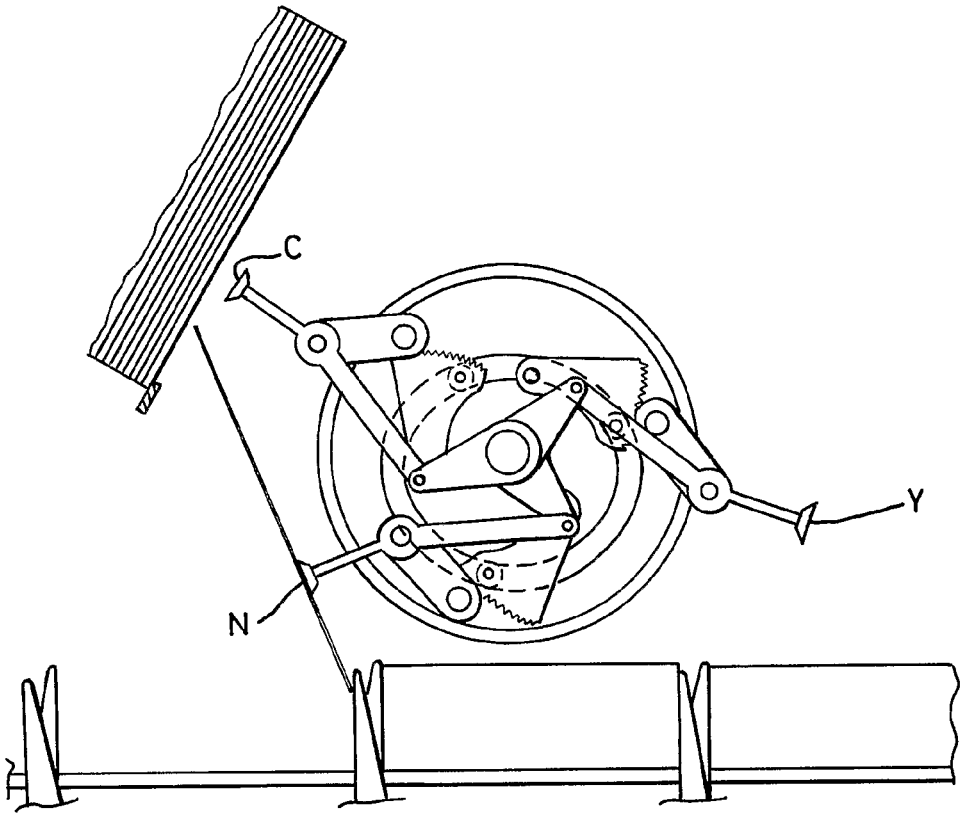
Figure 11:
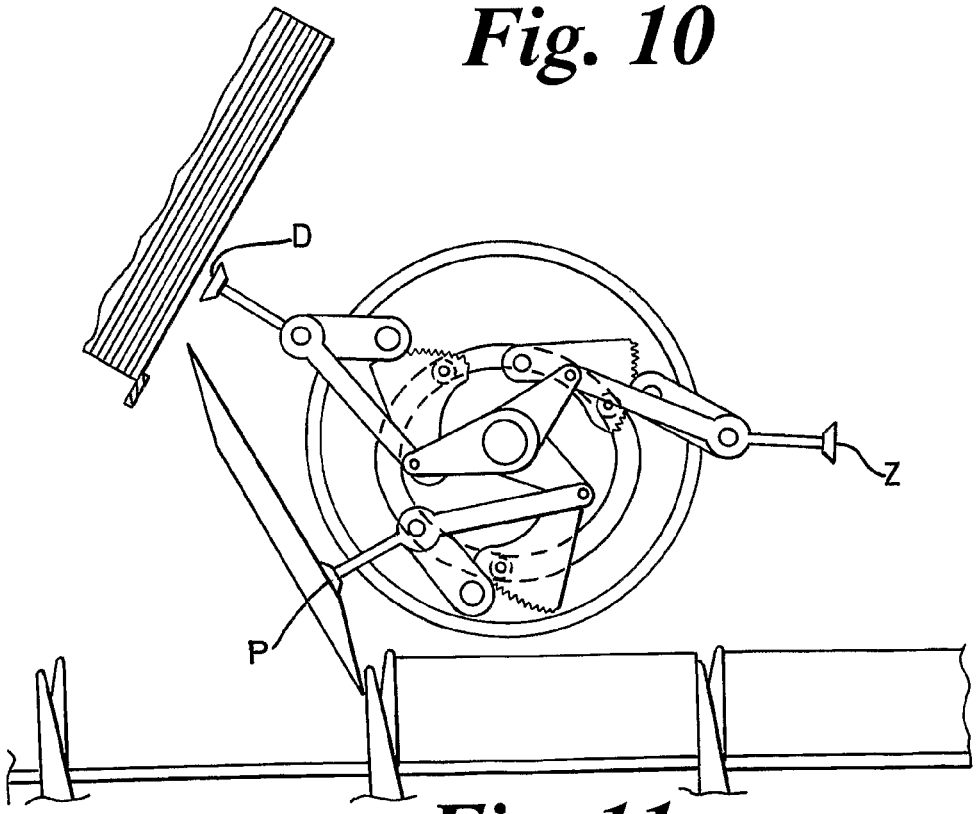
Figure 12:
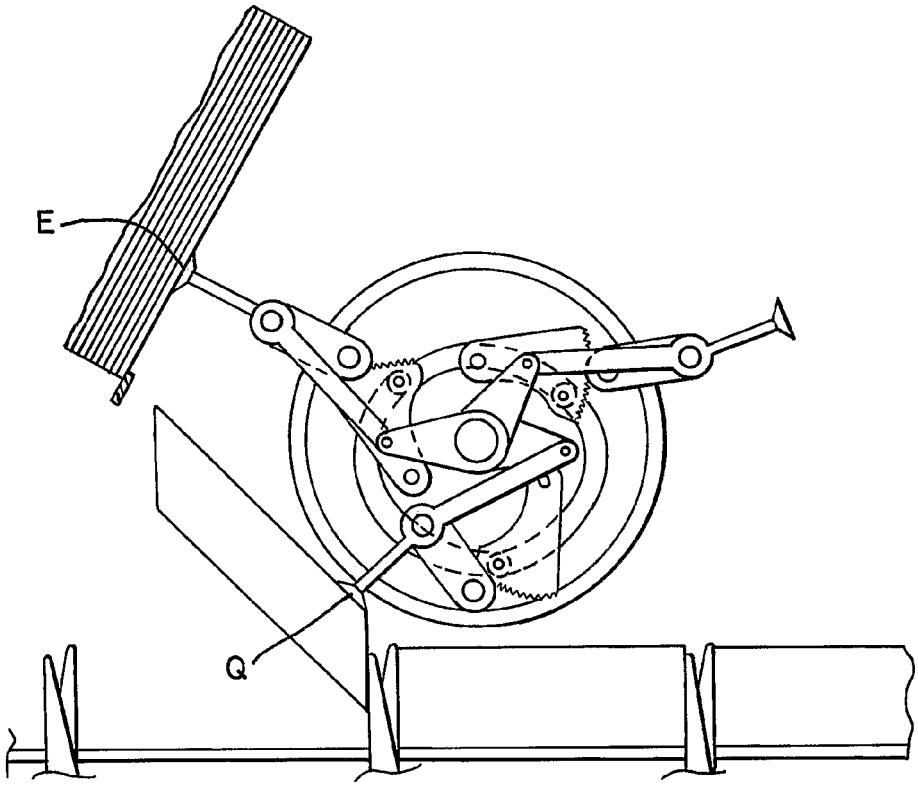
Figure 13:
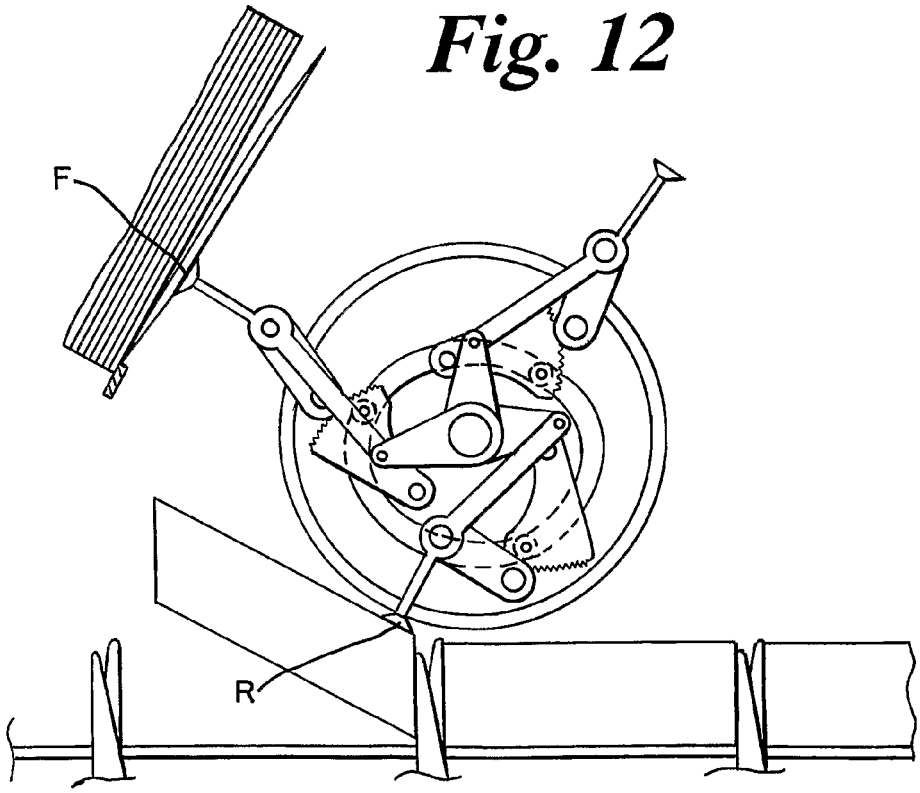
Figure 14:
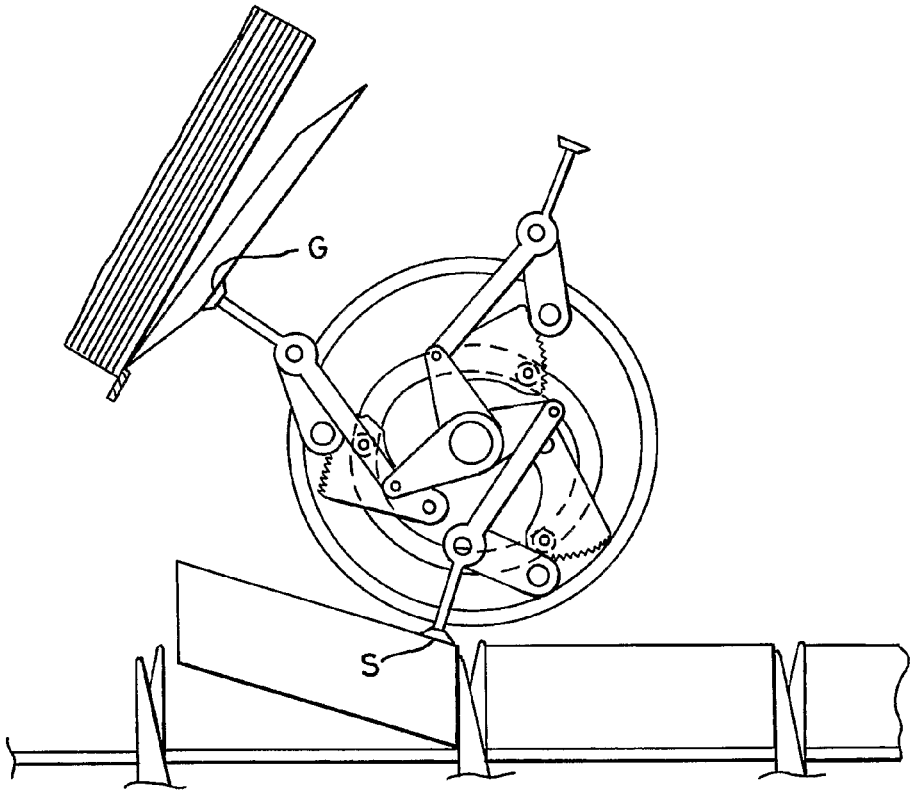
Figure 15:
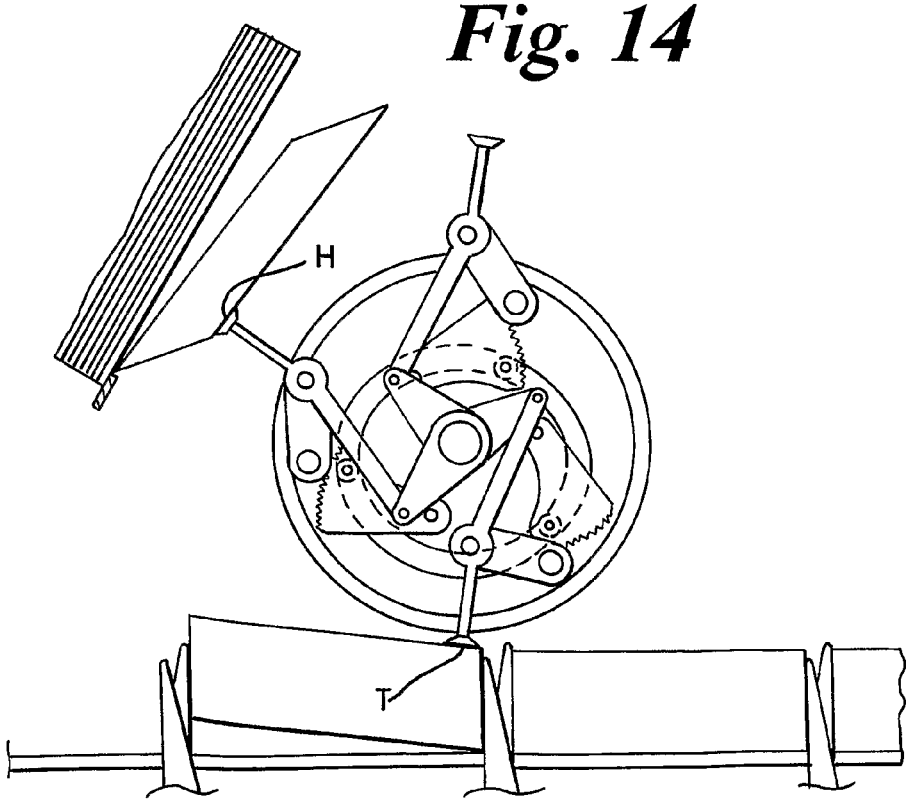
Figure 16:
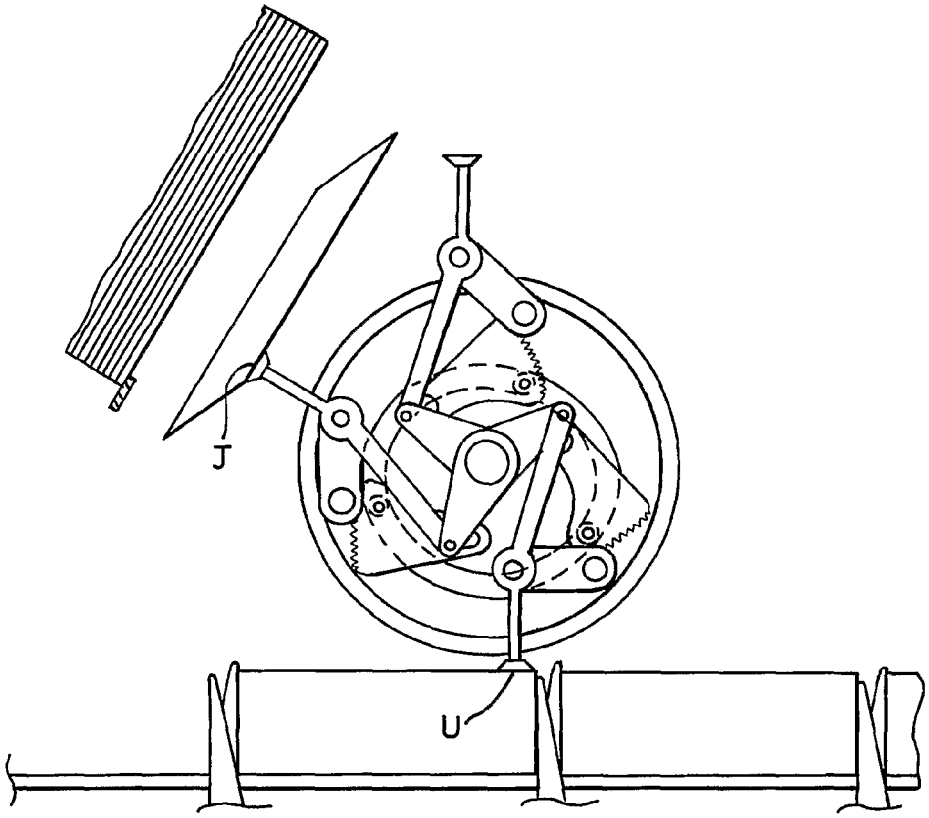
Figure 17:
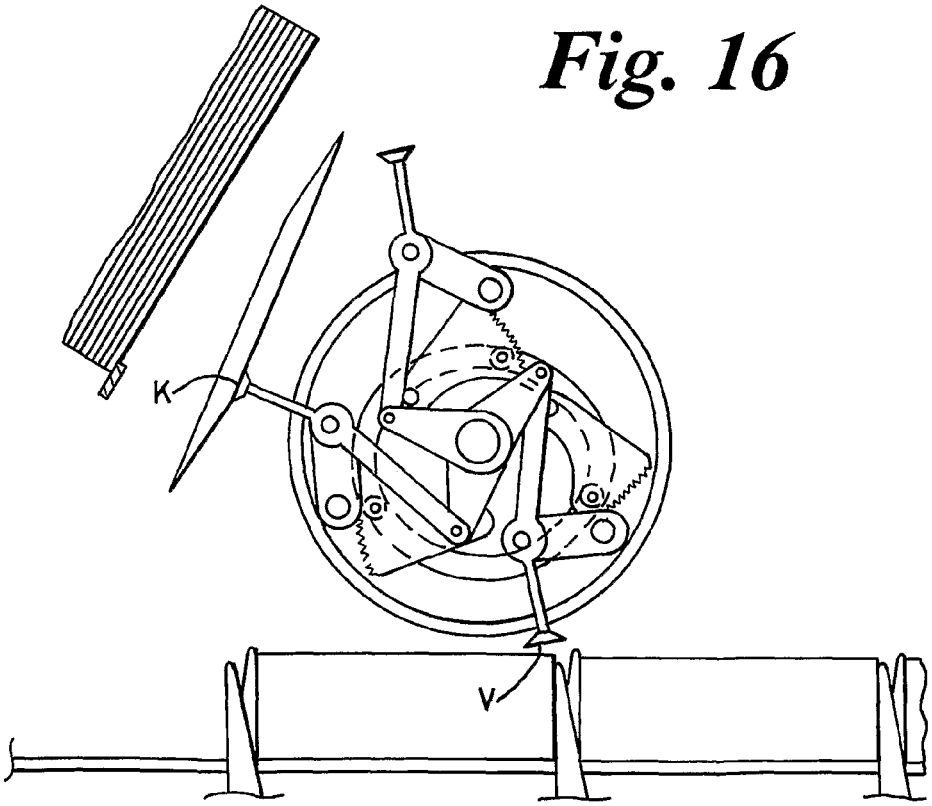

From position A (FIG. 8) to position D (FIG. 11) each set of suction cups 32 follows a curving path approaching the magazine 22 and reaches a "node point" at position E (FIG. 12) pushing slightly into the opening 21 of the magazine to ensure adequate contact with the foremost sleeve carton 20 for suction then to hold the nearside of the carton and pull it from the magazine as the suction cups move in a substantially straight line perpendicular to the plane of the opening 21 from the "node point" E to position H (FIG. 15) when the carton comes clear from the magazine. This substantially straight line movement of the suction cups is particularly advantageous in avoiding any slipping (or attempted slipping) between the cups and the carton as the sleeve carton is caused to open until the lower or leading corner or fold is about to be pulled free of the magazine, as shown at position G (FIG. 14). The carton 20 then springs back towards its collapsed condition, as indicated as it passes through positions J (FIG. 16) and K (FIG. 17) to position L (see again FIG. 8), thus thrusting its leading corner down towards the conveyor 24 through position M (FIG. 9) until first contacting leading flights 64 on the conveyor 24 at position N (FIG. 10). A slightly greater speed of the suction cups 32 through positions P (FIG. 11) and Q (FIG. 12) results in opening of the carton 20 again, following which the speed of the suction cups matches that of the conveyor 24 whilst passing through positions R (FIG. 13), S (FIG. 14) and T (FIG. 15) to press the carton into fully open position abutted by trailing flights 65 on the conveyor, as shown at position U (FIG. 16), at which point the suction cups are about to be connected to atmosphere (by the vacuum control means 33) to release the carton, from which the suction cups move clear, as shown at position V (FIG. 17).

Positions W, X, Y, Z (FIGS. 8 to 11 respectively) show the suction cups 32 moving towards the path of substantially constant radius from position Z to position A (Figure A) in readiness for extracting and transferring another carton 20 from the magazine 22 to the conveyor 24.

Figure 1:
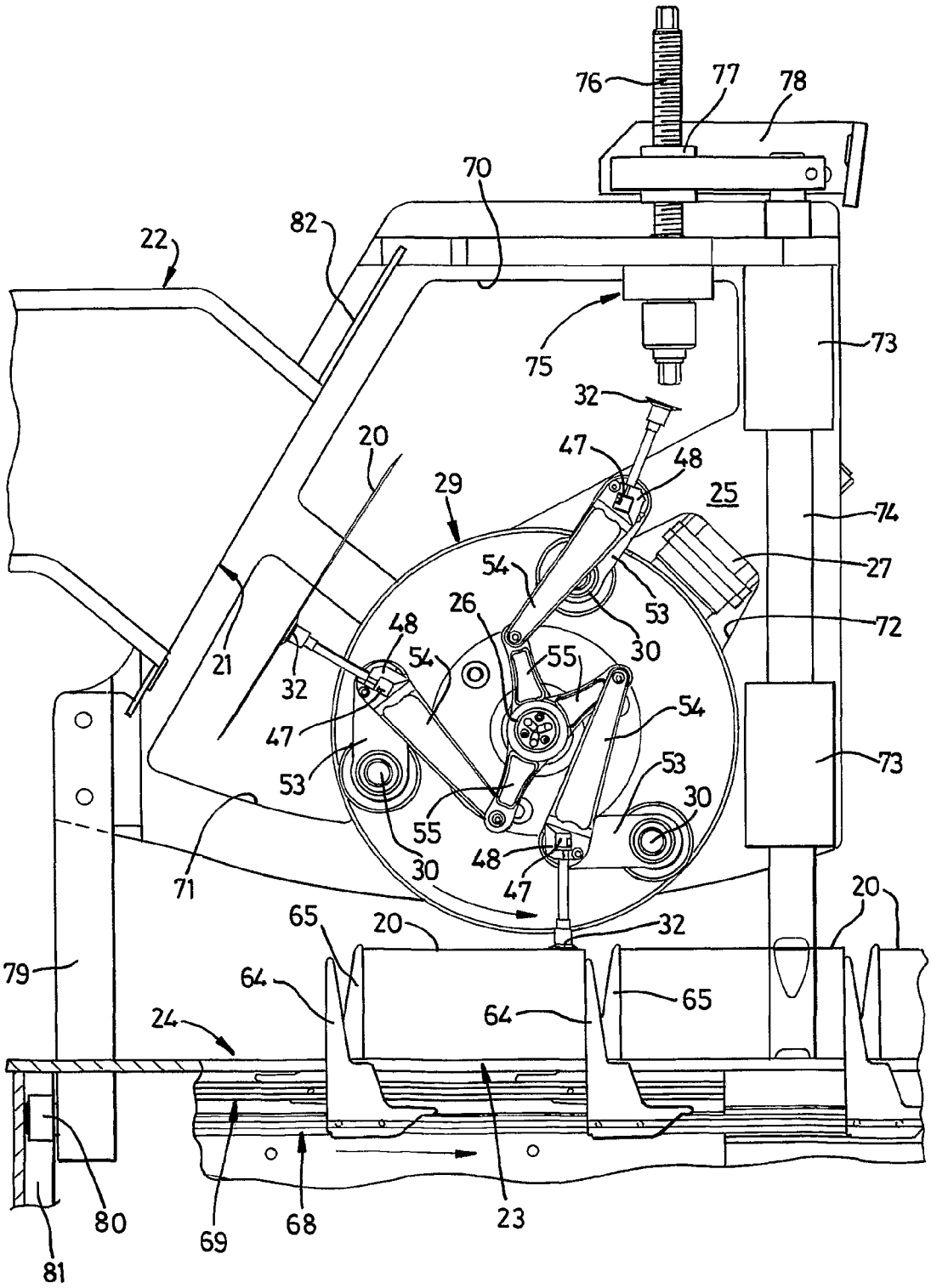
FIG. 1 is a side elevation of a rotary transfer mechanism in accordance with the invention.
Figure 2:
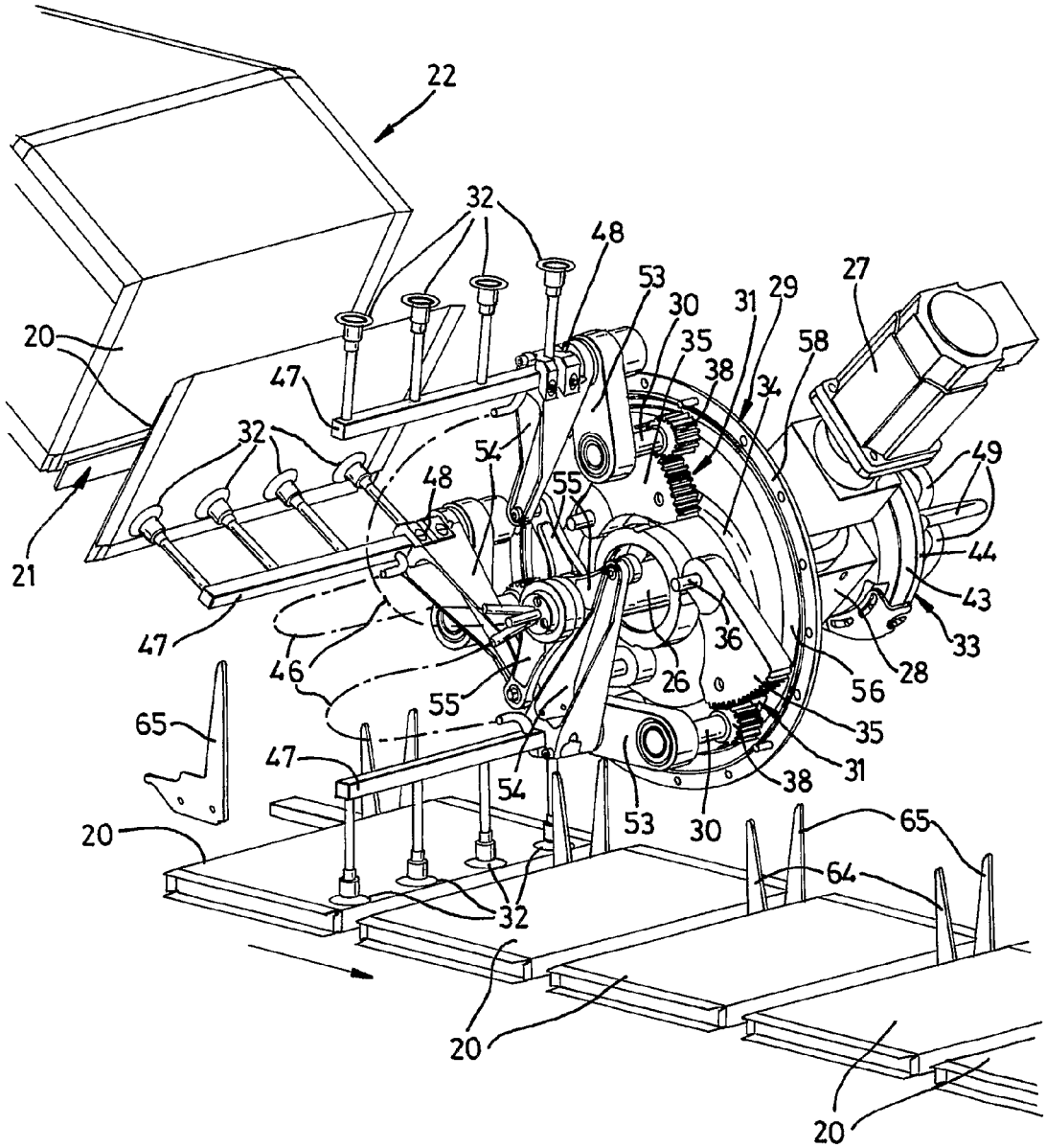
FIG. 2 is an isometric view of the mechanism as seen from the same side as in FIG. 1 and from downstream of the direction of conveyance of the erected cartons, with the nearer part of the casing forming the carrier means omitted.
Figure 3:
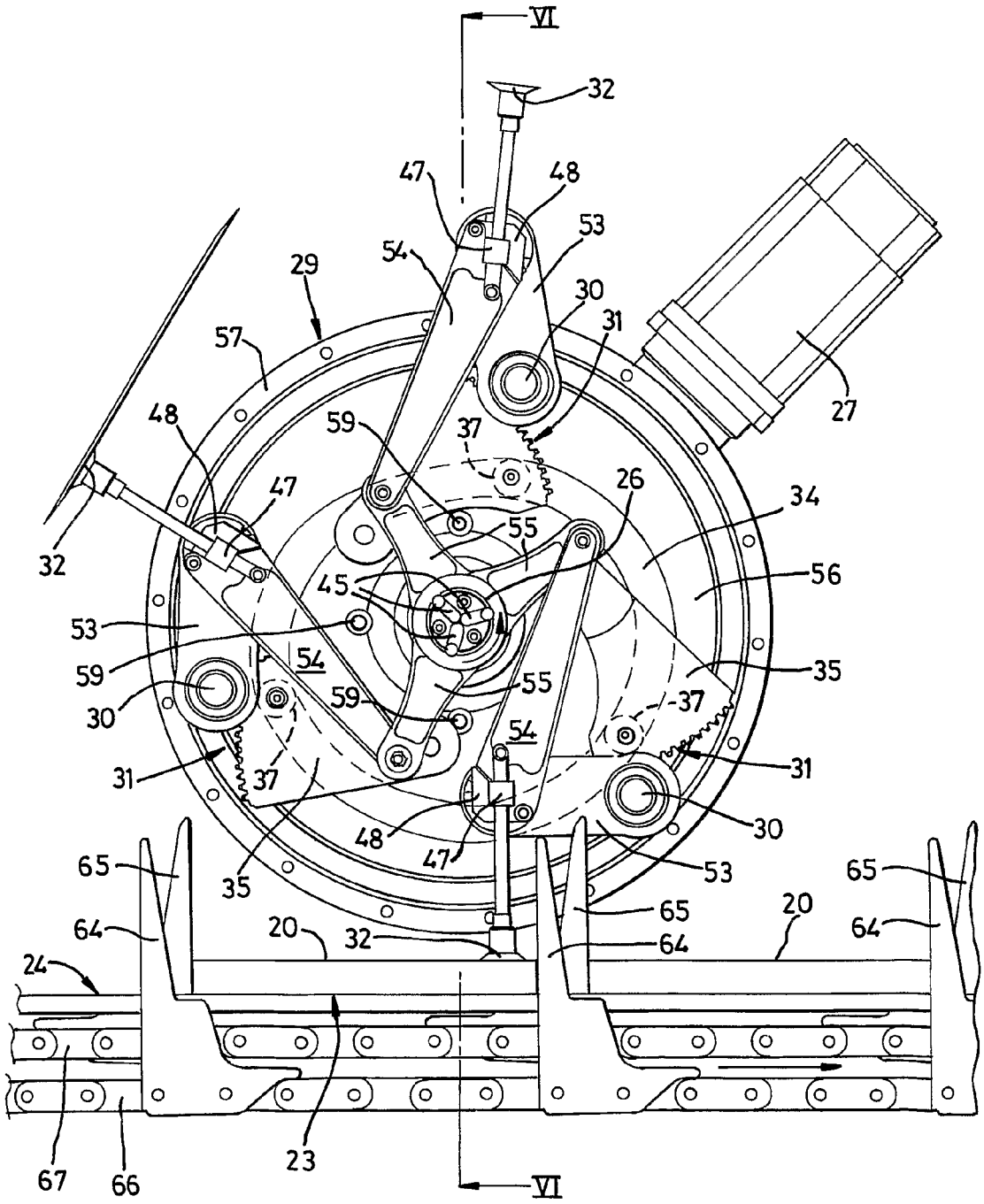
FIG. 3 is an enlarged elevation of the mechanism as seen from the left-hand side of FIG. 2 and indicating in broken lines the cam followers (not visible in FIG. 2) engaged with the cam track.
Figure 4:
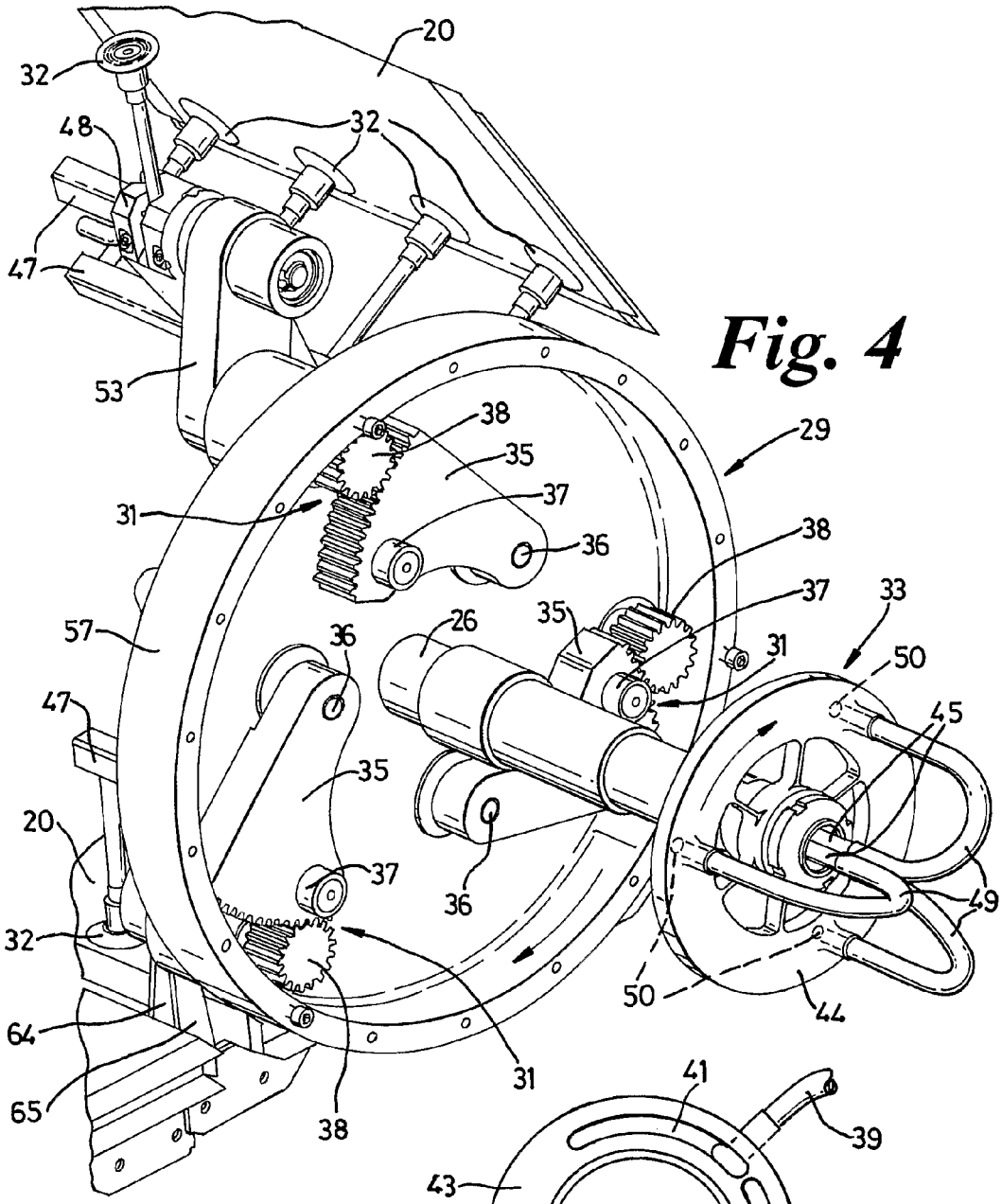
FIG. 4 is an isometric view of part of the mechanism as seen from the opposite side to FIG. 2 and from downstream of the direction of conveyance of the erected cartons, with the other part of the casing forming the carrier means omitted.
Figure 5:
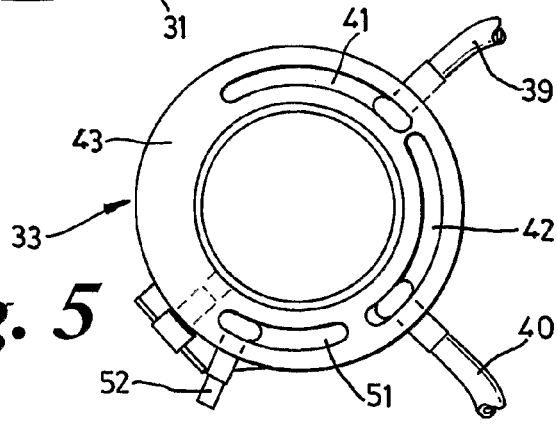
FIG. 5 is an elevation of the stationary porting plate for providing communication through ports in the rotatable porting plate shown in FIG. 4 with suction sources (not shown) for the suction cups shown in FIGS. 1 to 4 or for exhausting the suction cups to atmosphere during each cycle of the mechanism.
Figure 6:
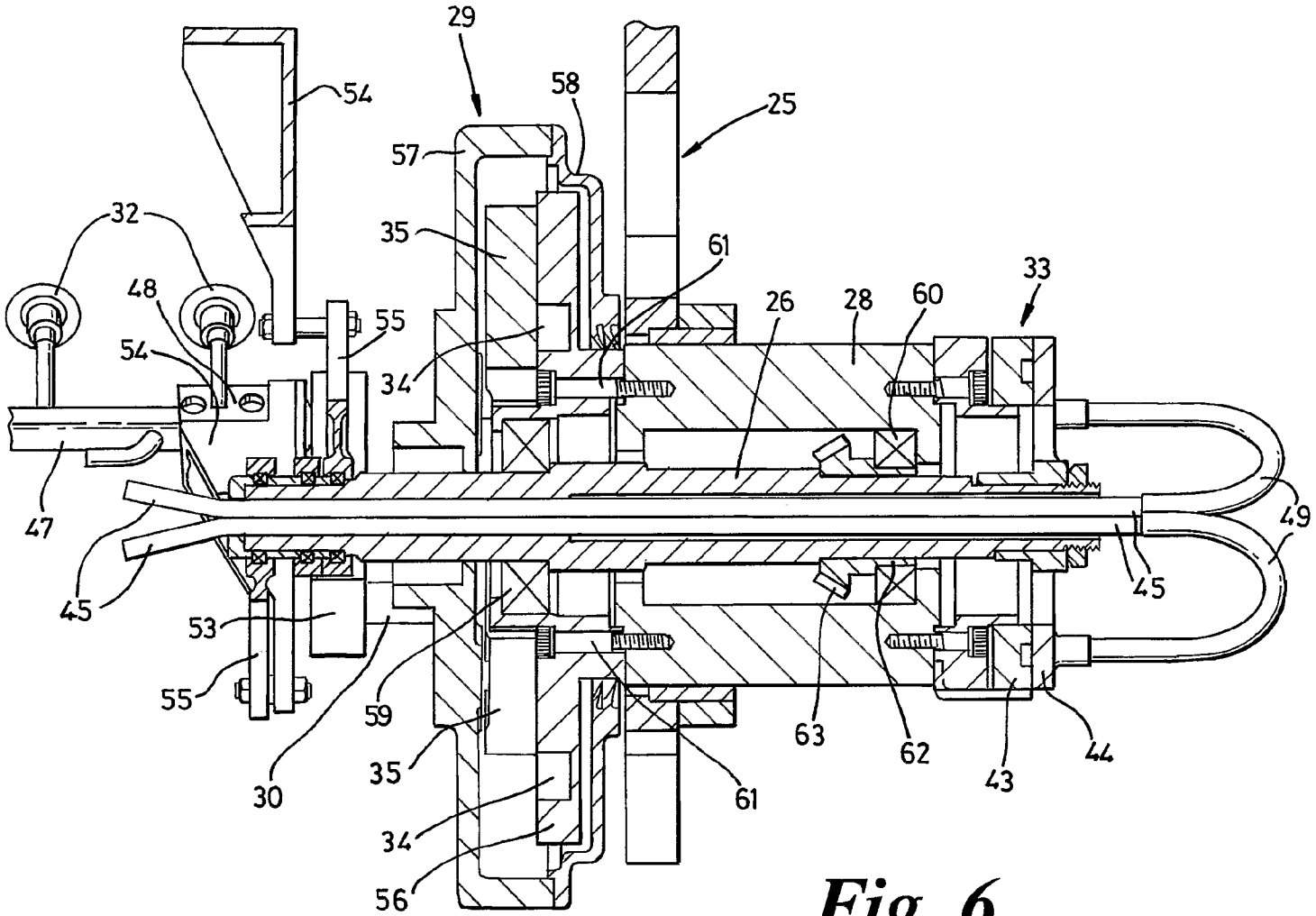
FIG. 6 is a fragmentary view of the mechanism mainly in section taken from the line VI-VI in Figure.

Only one set of flights 64, 65 is shown in FIGS. 2 and 4, a parallel set being omitted for the sake of clarity, each set being carried by chains 66, 67 respectively (FIG. 3 only) guided along tracks 68, 69 respectively (FIG. 1 only).

The support member 25 (FIGS. 1 and 6) is plate-like and has weight-reducing cut-outs 70, 71, 72, and is mounted for limited vertical movement (for adjustment of its position to suit different sizes of cartons 20, as will be referred to again presently) by attached bearings 73 in a vertical shaft 74 upstanding from the machine base (not shown), the vertical position being set by a screw jack 75 whose screw 76 passes through a nut 77 on a bracket 78 carried by machine framing (not shown) at the top of the shaft 74. The support member 25 is prevented from swinging about the shaft 74 by a depending arm 79 having a roller 80 engaged in a vertical channel 81 adjacent the conveyor 24.

FIG. 1 also shows the support member 25 provided with an interchangeable plate 82 carrying an interchangeable magazine 22 of a size and with a delivery opening or "gate" 21 to suit a particular size of carton.

Variations in sizes of cartons is illustrated by the different ones shown in FIGS. 1, 2, 7 to 17, and 18 respectively. However, the path of each set of suction cups 32 is substantially the same for every size of carton, but the speed is varied by the computer (not shown) programming of the servomotor during the cycle, and particularly through the delivery station to ensure correct interaction between the cartons and the flights, as is illustrated by comparing the intervals between the corresponding positions in FIG. 7 and FIG. 18 for the largest and smallest cartons respectively.

Considerable advantages accrue from the combination of integers of the mechanism described above.

While the fixed continuous cam determines the locus of the path of the suction cups, their motion is modified by the computer software programming the servomotor velocities. Thus, the 'overlaid' servo motion determines the speed, including acceleration and deceleration, at which the suction cups travel around the locus path, particularly through the delivery station relative to the constant velocity of the flights.

The primary advantage arising from the 'overlaid' servo motion is to allow exactly the same rotary feeder mechanism to be used for erecting cartons of different sizes into different flight pitches. Complete feeder mechanism assemblies may be held in stock without need of knowledge as to what flight length they may be applied, as each flight length will have servo motion profile software dedicated to it.

A secondary advantage afforded by the 'overlaid' servo motion is the ability to modify the motion profile of the suction cups for particular carton sizes within a given flight length machine. Two or more distinct predetermined motion profiles may be used to modify the position of the suction cups relative to the flights for different ranges of carton size, e.g. large, medium or small. A mathematical formula may be embedded within the software that will automatically modify the motion profile software responding to carton length and width dimension inputs, which can be made in various ways, e.g., at the main operator interface, such as an LED touch screen, from a menu recipe predetermined by the machine manufacturer, from a recipe input by the customer, or a combination thereof.

The invention claimed is:

1. A rotary transfer mechanism for extracting a flat article from the discharge opening of a magazine and depositing it at a receiving station on a conveyor comprising:

a support member;

a drive shaft rotatably mounted on and extending from the support member, a servomotor for rotatably driving the drive shaft;

a carrier rotatable with the drive shaft, said carrier including a gear segment on a pivot and a cam follower;

at least one support shaft rotatable on the carrier substantially parallel to the drive shaft, whereby the support shaft can orbit round the drive shaft;

at least one suction cup attached to the support shaft, said suction cup being carried by a cantilever from a bracket secured on one end of a crank arm, the other end of which is pivoted to the support shaft, the bracket being secured to one end of a link arm the other end of which is pivoted to one end of a rocker arm the other end of which is freely rotatable on the drive shaft, such that as the crank arm swings the suction cups are oriented firstly for contact with an article at the discharge opening of the magazine, and secondly as required for passage through the receiving station on the conveyor, a continuous stationary cam track for engaging the cam follower, said cam track being provided on a disc mounted inside a casing forming the carrier along with the gear segment and cam follower, and a pinion secured coaxially to the support shaft and meshing with the gear segment, said pinion, with the support shaft exiting through a sealed bearing, and with the drive shaft passing through the support member and coaxially through the casing via sealed bearings, from a gearbox and motor to the rocker arm, thus effecting driving of the casing through the link arm, the crank arm and the support shaft, whereby the profile of the cam track being such as to act on the gear segment along one part of the track to oscillate the pinion to create a partial path of the at least one suction cup with a node point at the discharge opening of the magazine, and along another part of the track to partially rotate the pinion so as to cause the suction cup to move past the receiving station in the same direction as the conveyor with the article generally parallel to the conveyor.

2. A rotary transfer mechanism for extracting an article from the discharge opening of a magazine and depositing the article at a receiving station on a conveyor comprising:

a support member, a drive shaft rotatably mounted on and extending from the support member, a carrier rotatable with the drive shaft, at least one support shaft rotatable on the carrier substantially parallel to the drive shaft, whereby the support shaft can orbit around the drive shaft, at least one suction cup attached to the support shaft, said suction cup being carried by a cantilever from a bracket secured on one end of a crank arm the other end of which is pivoted to the support shaft, said bracket being secured to one end of a link arm the other end of which is pivoted to one end of a rocker arm the other end of which is freely rotatable on the drive shaft, whereby as the crank arm swings the at least one suction cup is orientated accordingly, firstly for contact with an article at the discharge opening of the magazine, and secondly as required for passage through the receiving station on the conveyor a vacuum assembly for alternatively connecting the suction cup with a vacuum-producing means and the atmosphere, a continuous stationary cam track, a gear segment on a pivot on the carrier axially parallel to the drive shaft, a cam follower on the gear segment for engaging the cam track, and a pinion secured coaxially to the support shaft and permanently meshing with the gear segment, wherein the cam track is provided on a disc mounted inside a casing forming the carrier means along with the gear segment and cam follower, a servomotor for driving the drive shaft, said servomotor adapted to vary the speed of the at least one suction cup along its path to suit different sizes of articles;

wherein the profile of the cam track is such as to act on the gear segment along one part of the track to oscillate the pinion to create a partial path of the at least one suction cup with a node point at the discharge opening of the magazine, and along another part of the track to partially rotate the pinion so as to cause the suction cup to move past the receiving station in the same direction as the conveyor with the article generally parallel to the conveyor.

3. A rotary transfer mechanism as in claim 2, wherein the support shaft exits through a sealed bearing, and with the drive shaft passing through the support member and coaxially through the casing via sealed bearings, from a gearbox and motor to the rocker arm, thus effecting driving of the casing through the link arm, the crank arm and the support shaft.

4. A rotary transfer mechanism for extracting a flat article from the discharge opening of a magazine and depositing the article at a receiving station on a conveyor, comprising:

a support member, a drive shaft rotatably mounted on and extending from the support member;

a carrier connected to the drive shaft, said carrier having a pivotally mounted gear segment carrying a cam follower;

at least one suction cup adapted for contacting the article adjacent the discharge opening of the magazine;

at least one support shaft capable of orbiting the drive shaft, said support shaft associated with the at least one suction cup;

a crank arm pivoted to the support shaft at one end and to a bracket associated with the at least one suction cup at the other end;

a continuous stationary cam track for engaging the cam follower on the gear segment, a pinion secured to the support shaft and meshing with the gear segment, a motor for driving the drive shaft, and a rocker arm rotatable on the drive shaft and secured to a link arm for causing orientation of the at least one suction cup alternately for contact with an article at the discharge opening of the magazine and for delivering the article to the receiving station on the conveyor.

5. A rotary transfer mechanism according to claim 4, wherein the bracket is secured to one end of the link arm, and the other end of the link arm is pivoted to one end of the rocker arm.

* * * * *